US005171629A

United States Patent [19]

Heidel et al.

[11] Patent Number: 5,171,629

[45] Date of Patent: Dec. 15, 1992

[54] FLAME-RESISTANT CARRIER WEB FOR BITUMEN WEBS AND A PROCESS FOR ITS PRODUCTION

[75] Inventors: Peter Heidel, Bobingen; Wilhelm Adam, Neu-Isenburg, both of Fed. Rep. of Germany

[73] Assignee: Hoechst Aktiengesellschaft, Frankfurt am Main, Fed. Rep. of Germany

[21] Appl. No.: 464,996

[22] Filed: Jan. 16, 1990

[30] Foreign Application Priority Data

Jan. 17, 1989 [DE] Fed. Rep. of Germany ..... 3901152

[51] Int. Cl.[5] ..... B32B 17/06; B32B 17/12; B32B 27/00; C08G 12/00

[52] U.S. Cl. ..... 428/285; 428/286; 428/287; 428/290; 428/300; 428/301; 528/242; 528/243; 528/265; 528/268

[58] Field of Search ..... 428/194, 285, 286, 300, 428/301, 287, 290; 528/242, 243, 268, 265

[56] References Cited

U.S. PATENT DOCUMENTS

| | | | |
|---|---|---|---|
| Re. 33,023 | 8/1989 | Hiers | 428/285 |
| 2,863,842 | 12/1958 | Bonzagni | 528/265 |
| 3,941,734 | 3/1976 | Aignesberger et al. | 528/242 |
| 3,967,032 | 6/1976 | Plotz et al. | 428/300 |
| 4,143,016 | 3/1979 | Hönel et al. | 528/243 |
| 4,425,399 | 1/1984 | Bershas | 428/288 |
| 4,454,311 | 6/1984 | Bürge et al. | 528/148 |
| 4,657,801 | 4/1987 | Heidel et al. | 428/283 X |
| 4,752,513 | 6/1988 | Rau et al. | 428/91 |
| 4,755,423 | 7/1988 | Greiser et al. | 428/285 X |
| 5,017,426 | 5/1991 | Greiser et al. | 428/280 |
| 5,047,276 | 9/1991 | Chomarat et al. | 428/285 X |
| 5,071,945 | 12/1991 | Weichmann et al. | 528/265 |

*Primary Examiner*—George F. Lesmes
*Assistant Examiner*—Terrel Morris

[57] ABSTRACT

A carrier web of a sheet-like fiber material consisting of a glass fiber mat and a mat of synthetic fibers, which and are needled together and are end-consolidated with a polymer-free low-formaldehyde melamine-formaldehyde precondensate, and a process for its preparation are described.

The carrier web is preferably end-consolidated with a melamine-formaldehyde precondensate which is partly etherified and/or sulfamate-modified.

12 Claims, No Drawings

FLAME-RESISTANT CARRIER WEB FOR BITUMEN WEBS AND A PROCESS FOR ITS PRODUCTION

DESCRIPTION

The present invention relates to a multi-layered flame resistant carrier web and its production and to a bituminized roofing and sealing web containing this carrier web.

Various important requirements are imposed on carrier webs for roofing and sealing webs, these relating to their further processing to roofing and sealing webs and to the properties of the latter during and after laying on the substrates. A high strength of the carrier web within a wide temperature range should ensure a high processing and dimensional stability during bituminization and the burning properties evaluated in accordance with DIN 4102, Part 7, should be met. At the same time, the carrier web should also guarantee a high dimensional stability of the finished roofing and sealing web during laying on the roof or other substrates and a high flexibility and a certain extensibility to compensate for irregularities and weather-related changes in the dimensions of the covered substrate.

Carrier webs for bituminized roofing and sealing webs are described, for example, in European Patent Applications 0,176,847 and 242,524. They preferably consist of two non-woven materials, for example a glass fiber mat and a polyester fiber mat, joined to one another by stitching. The stitched layered material is then end-consolidated with a binder, acrylate-butadiene or acrylate-butadiene-styrene copolymers as a rule being employed.

German Offenlegungsschrift 26 19 087 describes binders, for example for polyester spun-bonded non-wovens, which consist of an acrylate-butadiene-styrene copolymer with an addition of 5 to 30% by weight of a melamine-formaldehyde precondensate.

These known binders are optimized in respect of textile technology data, such as strength, tear propagation resistance and the like, but their burning properties have to date been of only minor interest. The bituminous welded webs produced from layered materials consolidated with these binder systems have therefore only a limited fire retardancy in the context of DIN 4107, Part 7.

A process for the production of flame-resistant non-woven materials is known from German Auslegeschrift 1,149,688. In this process, a flameproofing agent is applied to the non-woven at the same time as the binder. In one of the examples of this publication, tetrahydrophosphonium chloride is employed as the flameproofing agent and is applied together with a binder system of a natural rubber latex and a melamine-formaldehyde precondensate. Subsequent consolidation of the non-woven is likewise carried out with a melamine-formaldehyde precondensate.

However, the non-wovens treated in this way are poorly suitable for the production of bituminous roofing and sealing webs which are flame-resistant in accordance with DIN 4107, Part 7, since they must contain a very large amount of flameproofing agents, for example antimony trioxide or phosphorus compounds, for this purpose. This high content of flameproofing agents leads to a very great reduction in the flexibility of the non-wovens, so that in this respect they no longer meet the requirements for the production of roofing and sealing webs.

The present invention thus relates to a carrier web for the production of roofing and sealing webs, which does not have the disadvantages of the known materials and in which, rather, a high mechanical stability, including at elevated temperatures, is combined with very good burning properties.

The carrier web according to the invention consists of a glass fiber mat and a mat of synthetic fibers which are needled to one another and end-consolidated with a polymer-free low-formaldehyde melamine-formaldehyde precondensate. The glass fiber mat contained in the carrier web according to the invention can be pre-consolidated in the customary manner using the customary binders, that is to say usually polymer binders or melamine resins. Because of the high bonding power of the low-formaldehyde melamine-formaldehyde precondensates employed according to the invention, it is possible, however, for the binder content used for pre-consolidation of the glass non-woven to be reduced considerably, without the final strength of the carrier web according to the invention being unacceptably reduced.

The synthetic fiber non-woven contained in the carrier web according to the invention can be produced from all types of synthetic fibers which have an adequate strength. Examples of possible fibers are aliphatic and aromatic polyamides, polyacrylonitrile and in particular polyester fibers. Those fiber types which have a high strength, a high modulus and a low shrinkage on heating are advantageously employed, so that the dimensions of the carrier web remain constant during further processing to roofing and sealing webs. Particularly preferred synthetic fiber material consists of polyethylene terephthalate, in particular the high-strength and low-shrinkage types. In principle, it is also possible, but not absolutely essential, for the synthetic fiber non-woven to consist of poorly combustible polyesters. Examples of commercially available synthetic fibers from which the synthetic fiber non-woven can be built up are ®Trevira, in particular the high-strength types, and the poorly combustible type ®Trevira CS.

The synthetic fiber non-woven can be built up from staple fibers, advantageously having cut lengths of between 1 and 100 mm, or from continuous fibers. Random non-wovens of continuous fibers, in particular types which have undergone a certain pre-consolidation by a calendering process, such as, for example, the so-called spun-bonded materials, are particularly preferred.

The low-formaldehyde melamine-formaldehyde precondensate with which the carrier web according to the invention is end-consolidated has a molar ratio of melamine to formaldehyde of 1:1.0 to 1:3.5, preferably 1:1.2 to 1:3. Of these low-formaldehyde melamine-formaldehyde precondensates, those which are partly etherified and/or sulfamate-modified are preferred. The partly etherified precondensates are partly etherified with lower alkanols, that is to say those having 1 to 4 carbon atoms, but in particular with methanol. The degree of etherification of the partly etherified precondensates has the characterizing feature that the precondensates contain 0.2 to 0.85, preferably 0.6 to 0.8 mol of ether groups per mol of formaldehyde. Particularly preferred low-formaldehyde partly etherified melamine-formaldehyde precondensates have a molar ratio of melamine to formaldehyde of 1:2 to 1:3 and contain 0.6 to 0.8 mol of methyl ether groups per mol of formaldehyde. Sulfamate-modified low-formaldehyde melamine-formaldehyde precondensates with which the carrier web according to the invention can be end-consolidated contain 1 to 20% by weight, preferably 5 to 15% by weight, of sulfamate, calculated as sodium sulfamate and based on the solid resin. Particularly preferred sulfamate-modified melamine-formaldehyde precondensates have a molar ratio of melamine to formaldehyde of 1:1.2 to 1:2 and contain 5 to 15% by weight of sulfamate, calculated as sodium sulfamate and based on the solid resin.

For specific areas of use, it may be advantageous for the melamine-formaldehyde precondensate contained in the carrier web according to the invention additionally to contain a small amount, that is to say about 1 to 5% by weight, based on the solid resin, of other modifying agents, in particular modifying agents which increase the plasticity, as long as the low combustibility required is not impaired to an unacceptable degree. Plasticizing additives of this type are, for example, di- and tri-ethylene glycol and ethers thereof or polyethylene glycols having molecular weights of up to 2000. However, carrier webs according to the invention which are end-consolidated with a melamine-formaldehyde pre-condensate without additional plasticizing modifying agents are particularly preferred.

Those carrier webs according to the invention which contain a combination of several preferred features are also particularly preferred.

Compared with known carrier webs, the carrier web according to the invention has the advantage of improved burning properties coupled with a high flexibility which is very suitable for the further processing. In this respect, it is considerably superior both to the non-woven materials known from DE-B-1,149,688 and to the non-woven materials prepared using a binder in accordance with DE-A-2,619,087. The mechanical properties of the carrier web according to the invention under the action of heat (temperature region, for example, 180° C.), such as occur during further processing to roofing and sealing webs, is also considerably improved. The same applies to the tear propagation resistance of the carrier web according to the invention, which is increased by about 25% in comparison with carrier webs which are consolidated on the ends with polyacrylate binders.

To produce the carrier web according to the invention described above, one of the synthetic fiber non-wovens specified above is needled to a glass fiber non-woven, which is preconsolidated if appropriate, and is then impregnated by spraying, padding or preferably dipping, with an aqueous melamine-formaldehyde precondensate of the abovementioned specification, to which about 0.5 to 3% of a known hardener, for example a hardener based on p-toluenesulfonic acid, has advantageously been added, squeezed off to the required resin uptake of 5 to 40, preferably 15 to 30% by weight, based on the non-impregnated material, intermediately dried if appropriate and subsequently hardened in a heating oven, as a rule at temperatures between 80 and 200, preferably 120° and 180° C., in the course of 5 to 30 minutes. The present patent application also relates to the production of the carrier web according to the invention.

The carrier web according to the invention can be particularly advantageously used for very different purposes. For example, on the basis of its poor combustibility, it can be used as a decoration carrier. Its use as a carrier material for bituminized roofing and sealing webs is particularly preferred.

The use according to the invention of the low-formaldehyde melamine-formaldehyde precondensates specified above also offers advantages in the production of the carrier web according to the invention: in particular, glass non-wovens having a relatively low binder content can be used. Since the character of the binder plays a relatively minor role in the case of a low binder content, it is possible to use, for example, less expensive glass non-wovens having a lower binder content, which do not have to have a poor combustibility.

We claim:

1. A sheet-like, fibrous carrier web comprising a glass fiber mat and a synthetic fibrous mat, said glass fiber mat and said synthetic fibrous mat being needled to one another and subsequently consolidated with an essentially polymer-free melamine-formaldehyde precondensate, said precondensate having a low content of free formaldehyde and a molar ratio of melamine to formaldehyde of 1:1.0 to 1:3.5 and being sulfamate-modified and optionally partly etherified.

2. A carrier web as claimed in claim 1, wherein the synthetic fibrous mat consists essentially of polyester fibers.

3. A carrier web as claimed in claim 1, wherein the synthetic fibrous mat is a spun-bonded material.

4. A carrier web as claimed in claim 1, wherein said precondensate is partly etherified with a lower alcohol.

5. A carrier web as claimed in claim 1, wherein said precondensate is partly etherified, and the partly etherified precondensate contains 0.2 to 0.85 mol of alkane ether groups per mol of formaldehyde.

6. A carrier web as claimed in claim 1, wherein said precondensate has a molar ratio of melamine to formaldehyde of 1:2 to 1:3 and contains 0.6 to 0.8 mol of methyl ether groups per mol of formaldehyde.

7. A carrier web as claimed in claim 1, wherein said precondensate contains 1 to 20% by weight of sulfamate, calculated as sodium sulfamate, and based on the weight of the precondensate.

8. A carrier web as claimed in claim 1, wherein the synthetic fibrous mat consists essentially of polyester fibers, and said polyester fibers comprise polyethylene terephthalate.

9. A carrier web as claimed in claim 1, wherein the synthetic fibrous mat comprises a non-woven material built up from staple fibers.

10. A carrier web as claimed in claim 1, wherein the said carrier web has been consolidate by impregnating the needled mats with an essentially aqueous solution of said precondensate, to which 0.5 to 5% by weight of hardener has been added, said precondensate having been subsequently hardened at elevated temperature.

11. A carrier web as claimed in claim 10, wherein the uptake of precondensate by the needled mats is about 5 to 40% by weight, based on the weight of the needled mats prior to impregnation.

12. A bituminized roofing or sealing web comprising the carrier web of claim 1.

* * * * *